US005572883A

United States Patent [19]

Roberts

[11] Patent Number: 5,572,883

[45] Date of Patent: Nov. 12, 1996

[54] COLD STORAGE APPARATUS

[75] Inventor: Linda Roberts, Warrington, United Kingdom

[73] Assignee: EA Technology Limited, United Kingdom

[21] Appl. No.: 351,231

[22] PCT Filed: Jun. 10, 1993

[86] PCT No.: PCT/GB93/01234

§ 371 Date: Feb. 6, 1995

§ 102(e) Date: Feb. 6, 1995

[87] PCT Pub. No.: WO93/25858

PCT Pub. Date: Dec. 23, 1993

[30] Foreign Application Priority Data

Jun. 11, 1992 [GB] United Kingdom ..... 9212444

[51] Int. Cl.[6] ..... F25D 12/02

[52] U.S. Cl. ..... 62/434; 62/393; 165/110

[58] Field of Search ..... 62/339, 430, 434, 62/79, 59, 118, 98, 99; 165/10, 111, 110

[56] References Cited

U.S. PATENT DOCUMENTS

| | | | |
|---|---|---|---|
| 2,101,953 | 12/1937 | Oman | 62/95 |
| 2,292,692 | 8/1942 | Huber | 62/434 |
| 2,779,171 | 1/1957 | Lindenblad | 62/434 |
| 2,996,894 | 8/1961 | Shade | 62/59 |
| 4,086,958 | 5/1978 | Lindner et al. | 165/104 S |
| 4,300,622 | 11/1981 | Lindner | 165/1 |
| 4,302,944 | 12/1981 | Gainer | 62/59 |
| 4,383,576 | 5/1983 | Bricard et al. | 165/104.17 |
| 4,446,910 | 5/1984 | Miller et al. | 165/1 |
| 4,509,344 | 4/1985 | Ludwigsen et al. | 62/76 |
| 4,864,831 | 9/1989 | Hino | 62/123 |
| 4,894,077 | 1/1990 | Simon et al. | 62/59 |
| 4,914,921 | 4/1990 | Knodel | 62/59 |

FOREIGN PATENT DOCUMENTS

| | | |
|---|---|---|
| 178 013 | 9/1935 | Switzerland . |
| 212742 | 3/1924 | United Kingdom . |
| 922169 | 3/1963 | United Kingdom . |
| 1 504 794 | 3/1978 | United Kingdom . |
| 2 053 434 | 2/1981 | United Kingdom . |

OTHER PUBLICATIONS

"Experimental and numerical study of direct contact heat exchangers," L. Tadrist, P. Seguin, R. Santini, J. Pantaloni, *International Journal of Heat and Mass Transfer* vol. 28, No. 6, pp. 1215–1227 (1985).

"Liquid–Liquid Heat Transfer in a Large Diameter Spray Column," D. E. Steinmeyer and C. E. Woodward, *Heat Transfer Philadelphia Symposium Series 92,* American Institute of Chemical Engineers, vol. 65 pp. 70–76.

"Direct–Contact Heat Transfer With Change of Phase: Evaporation of Drops in an Immiscible Liquid Medium," S. Sideman and Y. Taitel, *International Journal of Heat and Mass Transfer,* vol. 7, No. 11, pp. 1273–1289.

"A Dynamic Heat Storage System," T. L. Etherington, *Heating, Piping & Air Conditioning,* Dec. 1957, pp. 147–157.

"The Mechanism of Heat Transfer in a Spray Column Heat Exchanger," Ruth Letan and Ephraim Kehatfrom, *AIChE Journal,* May 1968, vol. 14, No. 3, pp. 398–405.

*Primary Examiner*—John M. Sollecito

*Attorney, Agent, or Firm*—Westman, Champlin & Kelly, P.A.

[57] ABSTRACT

Cold storage apparatus comprises a vessel (1) containing a storage liquid and a heat transfer liquid in direct contact with the storage liquid to transfer heat thereto or therefrom. The liquids are immiscible and of different densities and the heat transfer liquid remains liquid during heat transfer. The storage liquid comprises a liquid which solidifies when sufficiently cooled by the heat transfer liquid and the solidified storage liquid is of a different density to the storage liquid. The liquids form by gravity sequentially within the vessel (1) a first layer (4) of heat transfer liquid, a second layer (3) of storage liquid and a third layer (2) of solidified storage liquid. The cold storage apparatus includes heat transfer liquid circulating means (6) to deliver the heat transfer liquid to and from vessel (1). The heat transfer liquid circulating means (6) is arranged to deliver the heat transfer liquid into the first or second layer (4) or (3) at a temperature below the freezing point of the storage liquid.

29 Claims, 5 Drawing Sheets

COLD STORAGE APPARATUS

The present invention relates to cold storage apparatus and in particular to ice storage apparatus.

Ice storage provides the means to shift electrical load for cooling for instance air conditioning systems. As shown in FIG. 1, during off peak periods the chiller plant runs to charge up the ice store and then during peak periods (day time periods) the store can be used to provide some or all of the buildings' cooling requirements.

Much work has been done in developing an efficient means of providing cold storage in the form of ice store. An efficient cold storage method for producing ice uses a direct contact evaporator. Such an arrangement is disclosed in U.S. Pat. No. 4,864,831. In this arrangement a refrigerant is brought into direct contact with water in a tank to form ice which is used for heat exchange to provide chilled water for use in air conditioning. The refrigerant is sprayed onto or into the water and evaporates to absorb its latent heat of evaporation from the water, thus forming ice. The evaporating gaseous refrigerant is then condensed and recirculated. Although this method has an advantage of direct contact between the refrigerant (heat transfer fluid) and the water (storage liquid), it is important to ensure that no water vapour is carried over with the refrigerant vapour to the compressor if conventional compressors are to be used. Otherwise, non-conventional compressors must be used.

Thus the object of the present invention is to provide a direct contact cold storage apparatus which avoids the problem of water vapour being carried over with the refrigerant vapour and provides for efficient heat transfer.

The present invention provides cold storage apparatus comprising a vessel containing a storage liquid and a heat transfer liquid in direct contact with said storage liquid to transfer heat thereto or therefrom, said liquids being immiscible and of different densities, said heat transfer liquid remaining liquid during heat transfer, said storage liquid comprising a liquid which solidifies when sufficiently cooled by said heat transfer livid, the solidified storage liquid having a different density to said storage liquid, said liquids forming by gravity sequentially within said vessel a first layer of said heat transfer liquid, a second layer of said storage liquid, and a third layer of said solidified storage liquid; said cold storage apparatus including heat transfer liquid circulating means to deliver said heat transfer liquid to and from said vessel, said heat transfer liquid circulating means being arranged to deliver said heat transfer liquid into said first layer or said second layer at a temperature below the freezing point of said storage liquid.

Preferably the heat transfer liquid circulating means is arranged to deliver the heat transfer liquid into said second layer.

Preferably said solidified storage liquid is less dense that said storage liquid, and said heat transfer liquid is denser than said storage liquid. Conveniently in such an arrangement said storage liquid comprises water.

In one embodiment said heat transfer liquid circulating means is arranged to inject said heat transfer liquid in the form of droplets into said second layer.

In one embodiment feed means are provided to inject the storage liquid from the second layer into the heat transfer liquid in the heat transfer liquid circulating means at a position before the heat transfer liquid enters said second layer.

In one embodiment said feed means includes a pump to pump said storage liquid into said heat transfer liquid.

In another embodiment said heat transfer liquid circulating means includes a circulating conduit, and said feed means comprises a venturi arranged in said conduit, said venturi having an opening in a wall of a constricted part thereof, through which in use said storage liquid passes into said heat transfer liquid.

Preferably the heat transfer liquid circulating means includes a pump and heat exchange means.

In one embodiment a refrigeration circuit is coupled to the heat exchanging means to cool the heat transfer liquid.

To allow for the discharge of the coolth from the cold storage apparatus, in one embodiment the apparatus includes storage liquid circulating means for discharging coolth to a load to be cooled.

In one embodiment the storage liquid circulating means is arranged to circulate said storage liquid from said second layer into said third layer.

In another embodiment the storage liquid circulating means is arranged to circulate said solidified storage liquid from said third layer into said second layer.

Preferably said storage liquid circulating means includes a pump and heat exchange means.

The present invention thus provides a direct contact cold storage apparatus wherein the heat transfer liquid remains liquid during the heat transfer process. The preferred use of a heat transfer liquid which is denser than the storage liquid and the use of a storage liquid such as water wherein the frozen material is less dense than the liquid material, avoids the build-up of an ice boundary between the heat exchange liquid and the storage liquid. This provides for efficient heat transfer.

Examples of the present invention will now be described with reference to the drawings in which.

Figure 2:
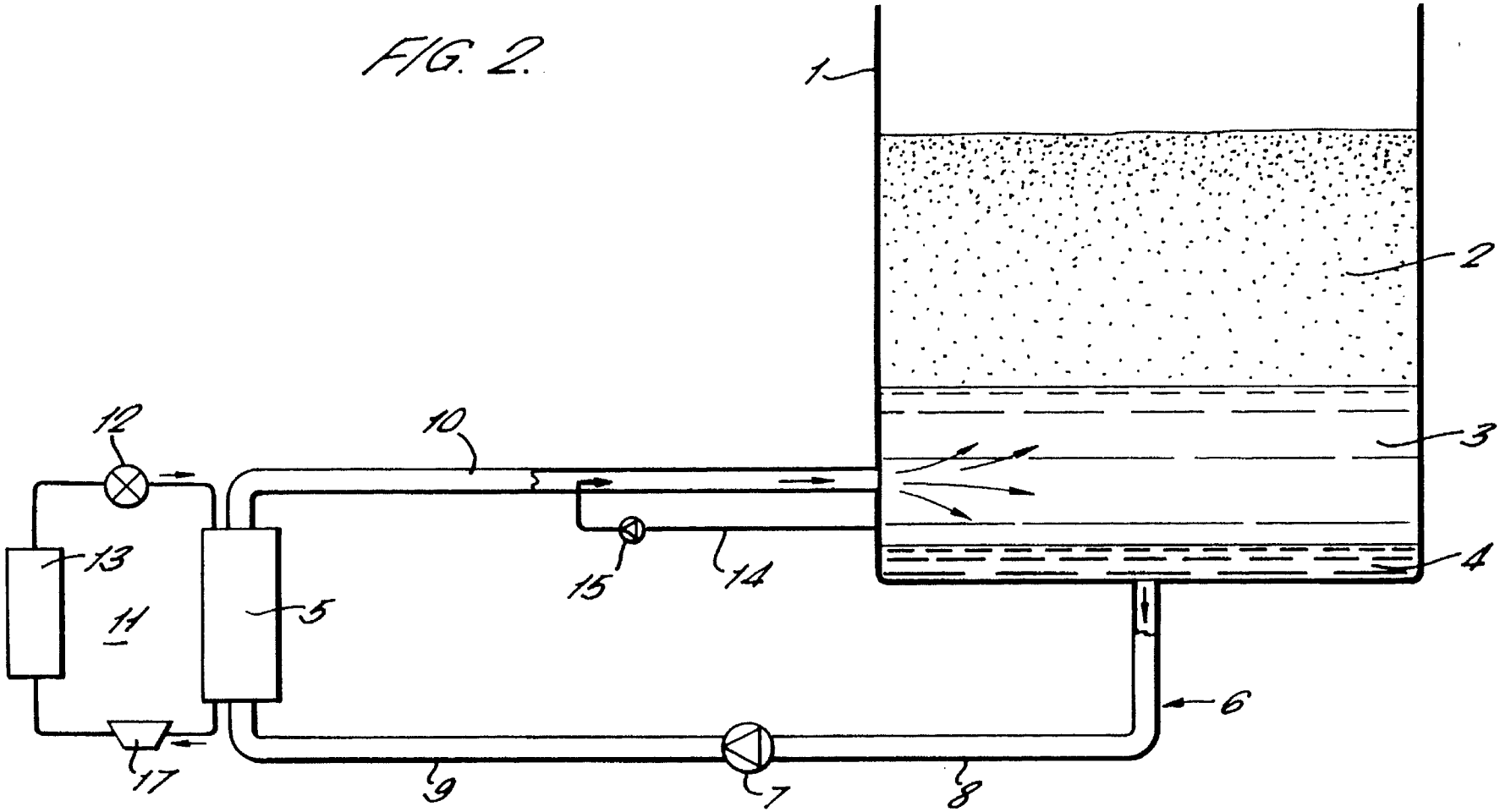
FIG. 2 illustrates a cold storage apparatus according to a first embodiment of the present invention.

Referring now to FIG. 2, the vessel 1 contains a storage liquid which is conveniently water. In the vessel 1 when the water is cooled by the heat transfer liquid it solidifies to form an ice slurry layer 2 which floats on a water layer 3. The ice formed in the vessel has a lower density than water and will thus float to the top of the vessel 1.

At the bottom of the vessel 1, there is a layer of heat transfer liquid 4. This liquid is of a higher density and is immiscible with water. Thus a clear boundary is formed between the heat transfer liquid 4 and the water 3. Circulation means 6 is provided to circulate the heat transfer liquid 4 from the bottom of the vessel via a heat exchanger 5 into the water layer 3 in the vessel 1. The circulating means 6 comprises an outlet pipe 8 connected to the bottom of the vessel 1 and a pump 7, a second pipe 9 connecting the pump 7 to the heat exchanger 5 and a third pipe 10 connecting the heat exchanger 5 to an intermediate position in the vessel 1 adjacent the water layer 3.

The heat transfer liquid 4 being circulated through the circulating means 6 is cooled by the heat exchanger 5 which is coupled to a refrigeration circuit 11. The refrigeration circuit 11 comprises a pump 17, a condensor 13 and an expansion device 12.

Thus the circulating means 6 circulates heat transfer liquid 4 from the bottom of the vessel 1 and intersperses the heat transfer liquid 4 in the water 3. Thus heat exchange between the water 3 and the heat exchange liquid 4 takes place and ice formed in the water 3 rises to join the layer of ice 2 and the heat transfer liquid 4 falls to the bottom of the vessel 1. This provides for good heat exchange since there is no ice build-up at the interface between the water and the heat transfer liquid.

To improve the heat exchange between the heat exchange fluid 4 and the water 3, feed means 14 which in the illustrated arrangement includes a pump 15 injects water 3 from the vessel 1 into the pipe 10. This arrangement facilitates the formation of droplets of water within the heat transfer liquid which droplets are well dispensed throughout the heat transfer liquid. Such provides for excellent heat transfer between the water and the heat transfer liquid in view of the increased interfacial surface area. Thus even before the heat transfer liquid has reached the vessel 1, some heat transfer to form ice will have already taken place.

Figure 1:
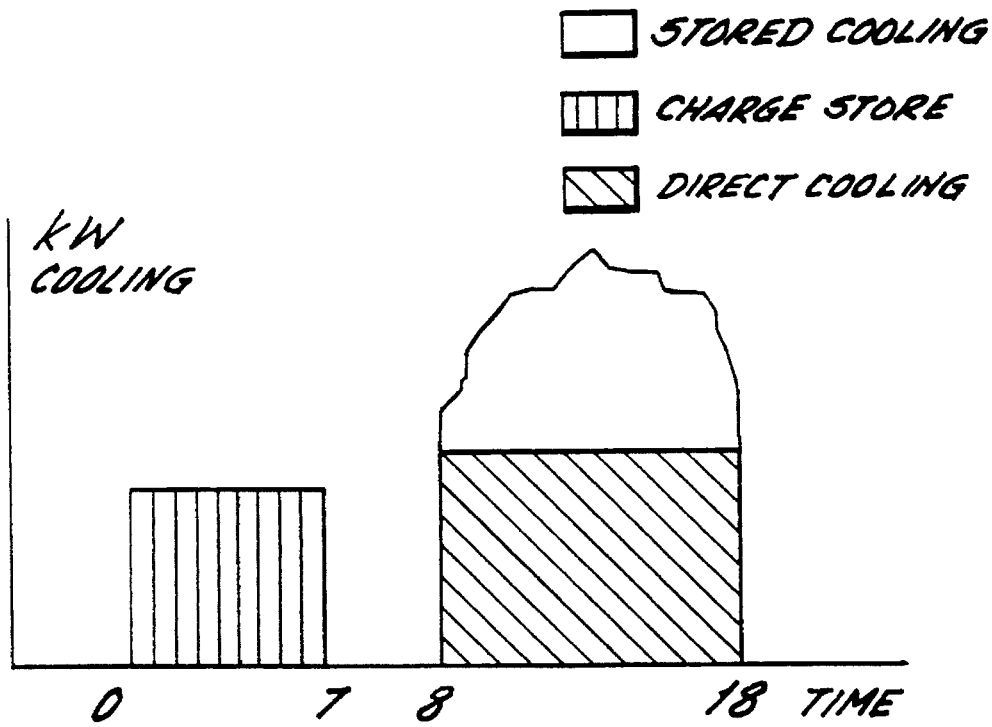
FIG. 1 is an illustration of the electrical load for a cold storage apparatus according to one embodiment of the present invention.
Figure 3:
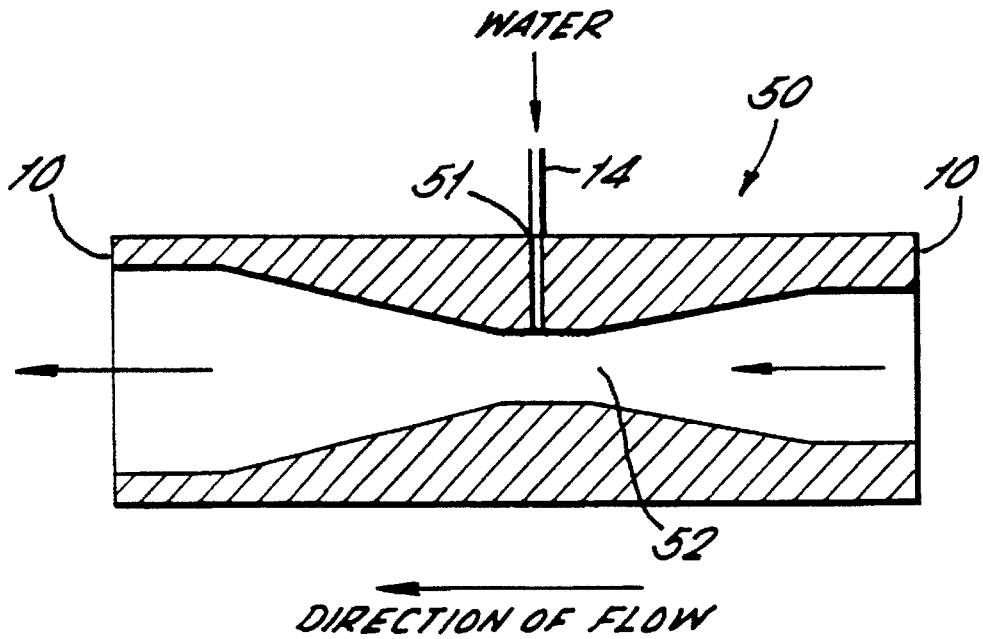
FIG. 3 illustrates the use of a venturi for the feed means in the arrangement of FIG. 2.

FIG. 3 illustrates a modification to the feed means 14 in FIG. 2. In this arrangement no pump 15 is required. Instead a venturi 50 is provided in the third pipe 10. The venturi 50 provides a pressure drop thereacross. An opening 51 is provided in the wall of the venturi at a position where the cross sectional area of the orifice 52 is at its smallest. The opening 51 communicates with the feed means 14 such that water from the water layer 3 is injected into the heat transfer liquid flowing in the third pipe as a result of the pressure drop. Turbulence within-both the venturi 50 and the third pipe 10 will enhance the formation of droplets of water within the heat transfer liquid and will increase the homogeneity of the distribution of the droplets, thus improving heat transfer between the liquids.

Figure 4:
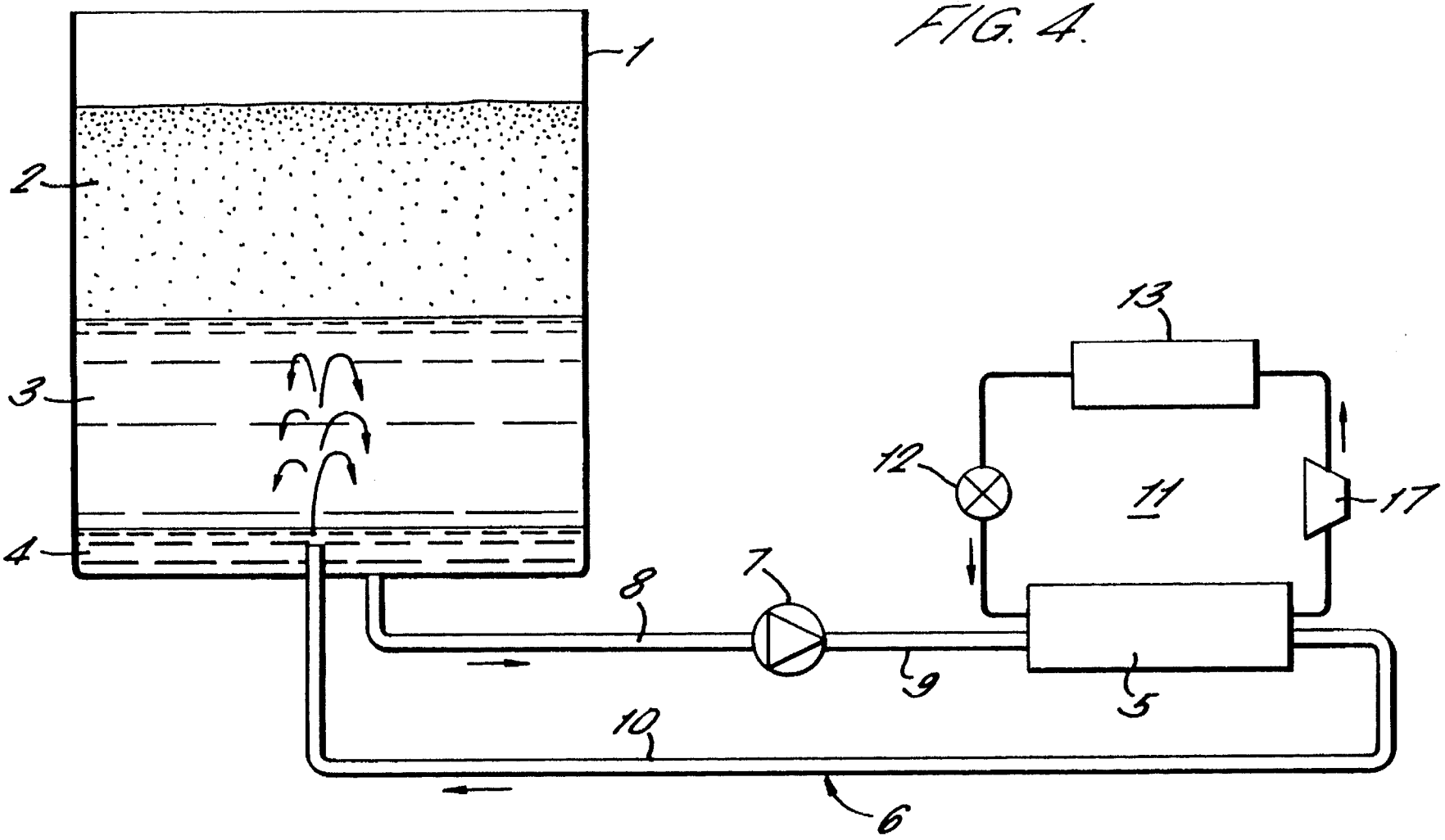
FIG. 4 illustrates a cold storage apparatus according to a second embodiment of the present invention.

FIG. 4 illustrates a further embodiment of the present invention wherein once again like reference numerals refer to like features. In this embodiment the heat transfer liquid 4 is removed from the bottom of the vessel 1 and is injected into the heat transfer layer 4 via the pipe 10 whereupon it fountains into the water layer 3 in order to intersperse the heat transfer liquid 4 in the water 3 and provide efficient heat transfer.

Figure 5:
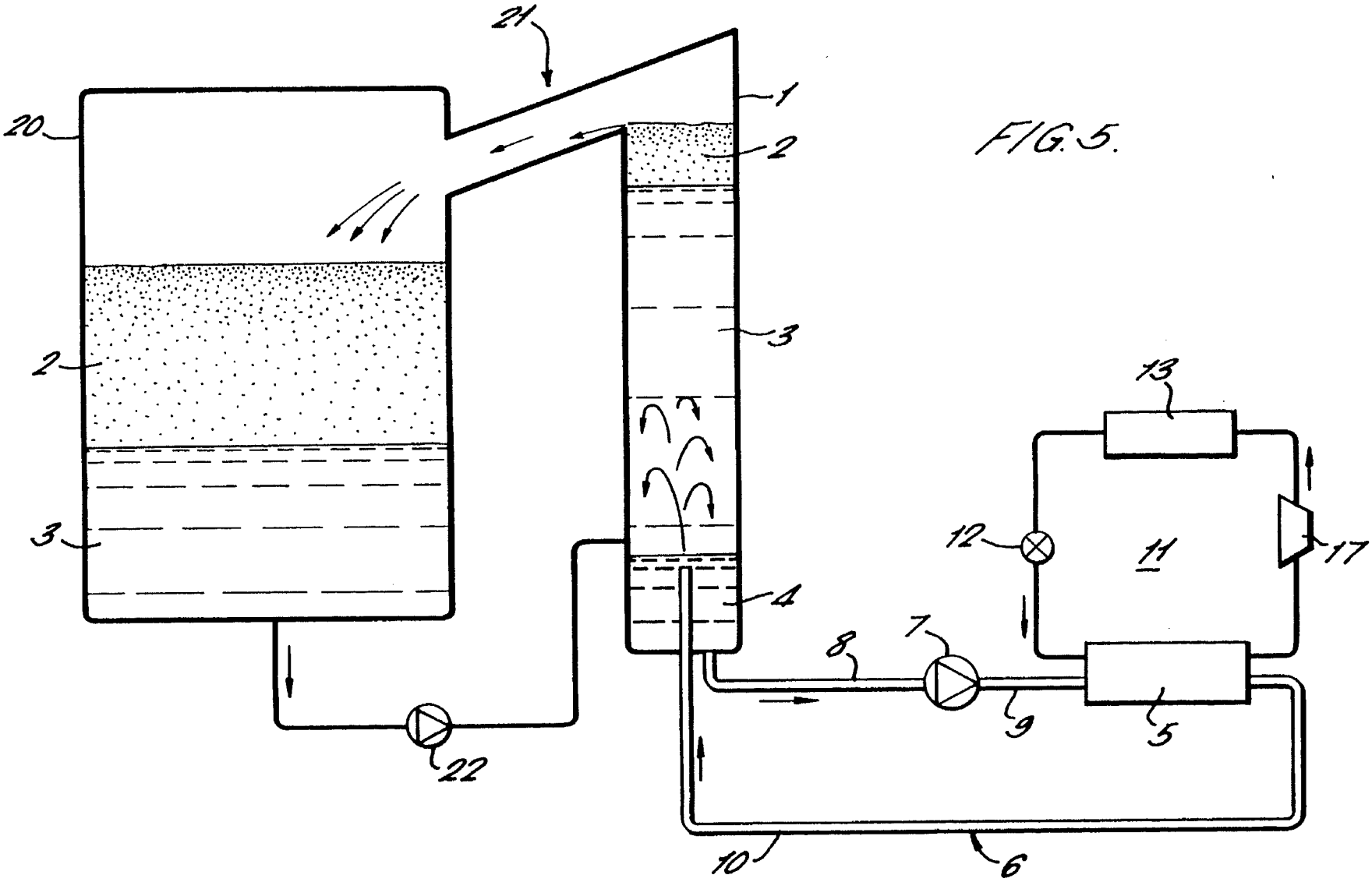
FIG. 5 illustrates a cold storage apparatus according to a third embodiment of the present invention.

FIG. 5 illustrates a further embodiment of the present invention wherein the arrangement is similar to that of the embodiment illustrated in FIG. 4 except that the ice 2 formed at the top of the vessel 1 is delivered to a storage vessel 20, by circulating means 21. A pump 22 is provided to deliver water 3 from the storage vessel 20 into the vessel 1, where upon the water 3 is cooled and frozen by the interspersion of the heat transfer liquid 4 being injected into the vessel 1. This arrangement provides for a separate storage vessel 20 for the ice being produced in the vessel 1.

In both of the arrangements illustrated in FIGS. 4 and 5 the feed means 14 of FIGS. 2 and 3 can be incorporated to improve heat exchange.

These embodiments of the present invention illustrate the advantage of using a heat transfer fluid which is denser than the storage fluid, and a storage fluid which when frozen has a lower density than the liquid. the chiller performance is unaffected by the amount of ice that has been produced, and the ice produced is in the form of a slurry to give good discharge characteristics.

Liquids that have been identified as being suitable as the heat transfer liquid in the embodiments described hereinbefore are 1.1.1 trichloroethane, 1.1.2 trichloroethylene and perflourohexane. Such liquids are immiscible with water and remain liquid over the temperature range of operation.

To enchance the separation of water and the heat transfer liquid, in addition to gravity other separation techniques can be used such as electrostatic filters, hydrocyclones, static filters and centrifugation.

To discharge the cold storage apparatus, either water or heat transfer fluid can be passed through the ice store to a heat exchanger in thermal contact with the load to be cooled, or the ice slurry can be circulated directly to the load.

Figure 6:
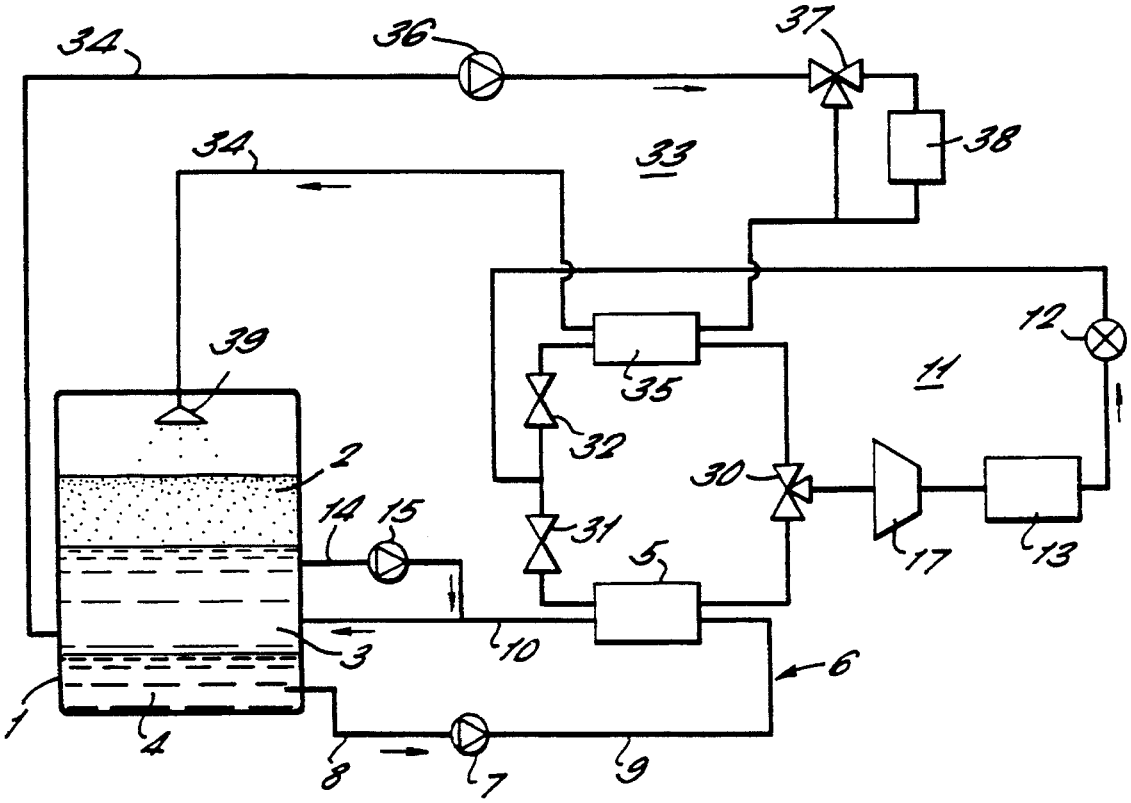
FIG. 6 illustrates an arrangement for discharging the cold storage apparatus.

FIG. 6 illustrates an arrangement for discharging the cold storage apparatus in combination with the arrangement for charging the cold storage apparatus. The arrangement for charging is the same as that shown in FIG. 2 and like reference numerals have been used to denote like components.

In the arrangement of FIG. 6 the refrigeration circuit differs in that a two way valve 30 is provided between the pump 17 and the heat exchanger 5. At the other side of the heat exchanger 5 is provided a first cut off valve 31. Thus during charging the two way valve 30 is set to pass heat exchange fluid within the refrigeration circuit 11 through the heat exchanger 5 to cool the heat exchange liquid 4.

During discharge the two way valve 30 is set to pass heat exchange fluid within the refrigeration circuit 11 through a second heat exchanger 35 which is provided with a second cut of valve 32 at the other side. The second heat exchanger 35 is provided within a discharge refrigeration loop generally indicated by reference numeral 33.

In the discharge refrigeration loop water 3 is pumped from the vessel 1 using a pipe 34 by a pump 36 via a two way valve 37 to a load 38 to cool the load 38. The water leaving the load 38 which has been heated by the load is passed to the second heat exchanger 35 so that the refrigeration circuit can provide some cooling, and then it is passed by the pipe 34 into the vessel 1 wherein it is sprayed onto the ice slurry 2 by nozzle 39.

In this arrangement cooling of the load is provided by both the refrigeration circuit 11 and the ice store in the vessel 1.

Figure 7:
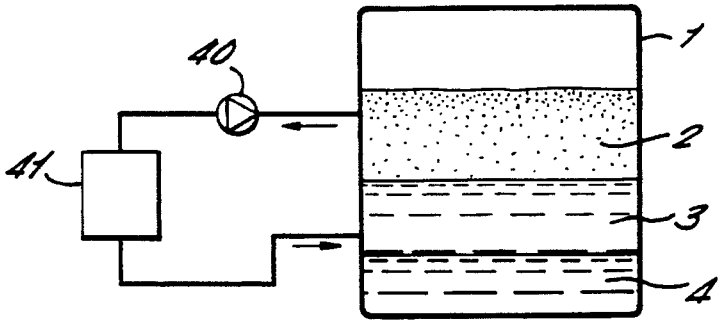
FIG. 7 illustrates a further arrangement for discharging the cold storage apparatus.

Referring now to FIG. 7, in this drawing an arrangement is shown for the discharge of the cold storage apparatus. In this arrangement ice slurry 2 is pumped from the vessel 1 by the slurry pump 40 and passed directly through the load 41 before being returned to the vessel 1 at the level of the water 3.

Thus as illustrated in FIGS. 6 and 7 the stored cool can be discharged and used to cool a load either in combination with a refrigeration circuit or on its own.

I claim:

1. Cold storage apparatus comprising a vessel containing a storage liquid and a heat transfer liquid in direct contact with said storage liquid to transfer heat thereto or therefrom, said liquids being immiscible and of different densities, said heat transfer liquid remaining liquid during heat transfer, said storage liquid comprising a liquid which solidifies when sufficiently cooled by said heat transfer liquid, the solidified storage liquid having a different density to said storage liquid, said liquids forming by gravity sequentially within said vessel a first layer of said heat transfer liquid, a second layer of said storage liquid, and a third layer of said solidified storage liquid; said cold storage apparatus including heat transfer liquid circulating means to deliver said heat transfer liquid to and from said vessel, said heat transfer liquid circulating means being arranged to deliver said heat transfer liquid directly into said second layer at a temperature below the freezing point of said storage liquid, and including feed means to inject said storage liquid from said second layer into said heat transfer liquid in said heat transfer liquid circulating means at a position before said heat transfer liquid enters said second layer.

2. Cold storage apparatus as claimed in claim 1 or wherein said solidified storage liquid is less dense than said storage liquid, and said heat transfer liquid is denser than said storage liquid.

3. Cold storage apparatus as claimed in claim 2 wherein said storage liquid comprises water.

4. Cold storage apparatus as claimed in claim 1 including a storage vessel containing said storage liquid and said solidified storage liquid, and circulating means to deliver said storage liquid from said storage vessel to said vessel and return said solidified storage liquid from said vessel to said storage vessel.

5. Cold storage apparatus as claimed claim 1 wherein said heat transfer liquid circulating means is arranged to inject said heat transfer liquid in the form of droplets into said second layer.

6. Cold storage apparatus as claimed in claim 5 wherein said feed means includes a pump to pump said storage liquid into said heat transfer liquid.

7. Cold storage apparatus as claimed in claim 1 wherein said heat transfer liquid circulating means includes a circulating conduit and said feed means comprises a venturi arranged in said conduit, said venturi having an opening in a wall of a constricted part thereof, through which in use said storage liquid passes into said heat transfer liquid.

8. Cold storage apparatus as claimed in claim 1 wherein said heat transfer liquid circulating means includes a pump and heat exchanging means.

9. Cold storage apparatus as claimed in claim 8 further including a refrigeration circuit coupled to said heat exchanging means to cool said heat transfer liquid.

10. Cold storage apparatus as claimed in claim 1 including storage liquid circulating means for discharging coolth from said storage liquid to a load to be cooled.

11. Cold storage apparatus as claimed in claim 10 wherein said storage liquid circulating means is arranged to circulate said storage liquid from said second layer into said third layer.

12. Cold storage apparatus as claimed in claim 10 wherein said storage liquid circulating means is arranged to circulate said solidified storage liquid from said third layer to said second layer.

13. Cold storage apparatus as claimed in claim 10 wherein said storage liquid circulating means includes a pump and heat exchanging means.

14. Cold storage apparatus comprising a vessel containing a storage liquid and a heat transfer liquid in direct contact with said storage liquid to transfer heat thereto or therefrom, said liquids being immiscible and of different densities, said heat transfer liquid remaining liquid during heat transfer, said storage liquid comprising a liquid which solidifies when sufficiently cooled by said heat transfer liquid, the solidified storage liquid having a different density to said storage liquid, said liquids forming by gravity sequentially within said vessel a first layer of said heat transfer liquid, a second layer of said storage liquid, and a third layer of said solidified storage liquid; said cold storage apparatus including heat transfer liquid circulating means to deliver said heat transfer liquid to and from said vessel, said heat transfer liquid circulating means being arranged to deliver said heat transfer liquid into said second layer at a temperature below the freezing point of said storage liquid, and including a storage vessel containing said storage liquid and said solidified storage liquid, and circulating means to deliver said storage liquid from said storage vessel to said first mentioned vessel and return said solidified storage liquid from said first mentioned vessel to said storage vessel.

15. Cold storage apparatus as claimed in claim 14 wherein said solidified storage liquid is less dense than said storage liquid, and said heat transfer liquid is denser than said storage liquid.

16. Cold storage apparatus as claimed in claim 15 wherein said storage liquid comprises water.

17. Cold storage apparatus as claimed in claim 14 wherein said heat transfer liquid circulating means is arranged to inject said heat transfer liquid in the form of droplets into said second layer.

18. Cold storage apparatus as claimed in claim 14 wherein said heat transfer liquid circulating means includes a pump and heat exchanging means.

19. Cold storage apparatus as claimed in claim 18 further including a refrigeration circuit coupled to said heat exchanging means to cool said heat transfer liquid.

20. Cold storage apparatus as claimed in claim 14 including storage liquid circulating means for discharging coolth from said storage liquid to a load to be cooled.

21. Cold storage apparatus as claimed in claim 20 wherein said storage liquid circulating means is arranged to circulate said storage liquid from said second layer into said third layer.

22. Cold storage apparatus as claimed in claim 20 wherein said storage liquid circulating means is arranged to circulate said solidified storage liquid from said third layer to said second layer.

23. Cold storage apparatus as claimed in claim 20 wherein said storage liquid circulating means includes a pump and heat exchanging means.

24. Cold storage apparatus comprising a vessel containing a storage liquid and a heat transfer liquid in direct contact with said storage liquid to transfer heat thereto or therefrom, said liquids being immiscible and of different densities, said heat transfer liquid remaining liquid during heat transfer, said storage liquid comprising a liquid which solidifies when sufficiently cooled by said heat transfer liquid, the solidified storage liquid having a different density to said storage liquid, said liquids forming by gravity sequentially within said vessel a first layer of said heat transfer liquid, a second layer of said storage liquid, and a third layer of said solidified storage liquid; said cold storage apparatus including heat transfer liquid circulating means to deliver said heat transfer liquid to and from said vessel, said heat transfer liquid circulating means being arranged to deliver said heat transfer liquid into said second layer at a temperature below the freezing point of said storage liquid, and including storage liquid circulating means for discharging coolth from said storage liquid to a load to be cooled.

25. Cold storage apparatus as claimed in claim 24 wherein said solidified storage liquid is less dense than said storage liquid, and said heat transfer liquid is denser than said storage liquid.

26. Cold storage apparatus as claimed in claim 25 wherein said storage liquid comprises water.

27. Cold storage apparatus as claimed in claim 24 wherein said heat transfer liquid circulating means is arranged to inject said heat transfer liquid in the form of droplets into said second layer.

28. Cold storage apparatus as claimed in claim 24 wherein said heat transfer liquid circulating means includes a pump and heat exchanging means.

29. Cold storage apparatus as claimed in claim 28 further including a refrigeration circuit coupled to said heat exchanging means to cool said heat transfer liquid.

* * * * *